US005854961A

United States Patent [19]

Wibbels et al.

[11] Patent Number: 5,854,961

[45] Date of Patent: Dec. 29, 1998

[54] ELECTROPHOTOGRAPHY DEVELOPER CANISTER WITH MATERIAL-MOVING ROLLER

[75] Inventors: Mark Wibbels; Gar P. Kelly, both of Boise; Richard L. Swantner, Meridian, all of Id.

[73] Assignee: Hewlett-Packard Company, Palo Alto, Calif.

[21] Appl. No.: 898,023

[22] Filed: Jul. 21, 1997

Related U.S. Application Data

[63] Continuation of Ser. No. 504,164, Jul. 19, 1995, abandoned.

[51] Int. Cl.[6] ..... G03G 15/08

[52] U.S. Cl. ..... 399/281; 399/254; 399/283; 492/35

[58] Field of Search ..... 399/252, 254, 399/256, 272, 273, 274, 281, 283, 284; 492/18, 31, 33, 35, 36; 72/196; 366/157.2, 320

[56] References Cited

U.S. PATENT DOCUMENTS

| | | | |
|---|---|---|---|
| 24,883 | 7/1859 | Montgomery | 72/196 |
| 1,868,302 | 7/1932 | Auger | 72/196 |
| 2,176,835 | 10/1939 | Cumfer | 492/35 |
| 2,717,037 | 9/1955 | Goodwillie | 492/35 |
| 3,405,884 | 10/1968 | Patterson, Jr. | 492/35 |
| 3,441,463 | 4/1969 | Buck | 492/35 |
| 3,465,979 | 9/1969 | Henry et al. | 492/35 |
| 3,926,517 | 12/1975 | Nagahara | 399/273 |
| 4,026,241 | 5/1977 | Takebe et al. | 399/256 |
| 4,461,238 | 7/1984 | Baier et al. | 399/257 |
| 4,577,587 | 3/1986 | Kamezaki | 399/254 |
| 4,855,783 | 8/1989 | Takashima et al. | 399/256 |
| 4,906,104 | 3/1990 | Nishise et al. | 366/319 |
| 4,980,724 | 12/1990 | Tanaka | 399/256 |
| 5,016,053 | 5/1991 | Ibuchi et al. | 399/254 |
| 5,054,419 | 10/1991 | Itaya et al. | 399/274 |
| 5,071,083 | 12/1991 | Tubota et al. | 492/35 |
| 5,096,407 | 3/1992 | Nebeling | 492/35 |
| 5,189,474 | 2/1993 | Miya et al. | 399/255 |
| 5,264,900 | 11/1993 | Momiyama et al. | 399/256 |
| 5,305,064 | 4/1994 | Trott et al. | 399/258 |
| 5,502,552 | 3/1996 | Iwata et al. | 399/222 |
| 5,510,883 | 4/1996 | Kimura et al. | 399/256 |
| 5,572,297 | 11/1996 | Kawashima | 399/257 |
| 5,682,584 | 10/1997 | Hattori et al. | 399/256 X |

*Primary Examiner*—Arthur T. Grimley
*Assistant Examiner*—Sophia S. Chen

[57] ABSTRACT

Embodiments of a material-moving electrophotography roller are shown and described, each embodiment having an outer surface having ridges. The ridges may extend in right-handed or left-handed orientation, or in other angled (non-radial and non-horizontal) manner. The ridges lie in such a pattern so that the ridges move material radially over the roller or against a restrictive surface, and so that there are no gaps in the contact between the ridges and the material or the restrictive surface during a revolution of the roller. The roller is preferably made of a shaft covered by a sleeve or tube of non-disintegrating material with external ridges. The ridged tube is twisted and secured to the shaft so that the ridges run preferably and substantially at a 45°–75° angle from perpendicular to the roller axis. Alternatively, a monofilament line or other non-disintegrating cord may be wrapped and secured around a cylinder to create the ridges and troughs necessary for material movement and for distribution of the time of engagement of the ridges on material or surfaces.

18 Claims, 5 Drawing Sheets

ELECTROPHOTOGRAPHY DEVELOPER CANISTER WITH MATERIAL-MOVING ROLLER

This application is a continuation of application Ser. No. 08/504,164, filed Jul. 19, 1995, now abandoned.

FIELD OF THE INVENTION

This invention relates, generally, to an apparatus for moving material around a cylinder in electrophotography. More specifically, this invention relates to a cylinder or roller which moves material without contamination of the material and without producing undo impulse or thrust loading of the roller drive train.

BACKGROUND OF THE INVENTION

Currently, several rollers are used in electrophotography (EP) developer systems to move dry developer material to various positions in the developer canister. A schematic, side view diagram of a developer canister (10) in contact with a photoconductor drum (12) is shown in FIG. 1.

The apparatus and operation of the developer in FIG. 1 may be explained by tracing the path of the development material through the developer canister (10). The development material typically comprises toner and discrete carrier particles and herein is called "toner 14". Excess or residual toner (14) is removed from the developer sleeve (16) by a blade (18). The toner builds up on the blade (18) and tends to fall down toward the upper roller (20). Upper roller (20) rotates clockwise, as viewed from the perspective of FIG. 1, and moves or carries toner (14) over its top and into the canister reservoir (22). In this reservoir (22), two mixing rollers (24) rotate counter to each other to mix the toner (14) to achieve a homogenous toner supply. Lower roller (26) rotates in contact with toner (14) from the bottom of the mixed reservoir (22) and moves toner (14) against a resistive surface (27) and toward the metering rod (28). The metering rod (28) is in close contact with the sleeve (16), and approximately a monolayer of toner (14) is carried through the nip between the rod (28) and sleeve (16), so that a controlled and metered layer of toner adheres to the sleeve (16). Toner (14) that does not transfer from the sleeve (16) to the photoconductor ("OPC") (12) travels back around toward the blade (18) for removal and return to the reservoir (22).

A plurality of such developer canisters (10) are typically used for a color developer unit, with each being for a different color of toner. Typical toners (14) may comprise, for example, 40–50 micron ferrite spherical particles and 10–15 micron color particles or 7–12 micron black particles.

Upper roller (20) and lower roller (26) are shown in FIG. 1 as embodiments of the invention, having outer surfaces similar to that of roller (50) of FIGS. 4A and 4B. In the past, however, conventional upper and lower rollers have been one of two designs: a) long shafts having a thin coating of open-cell foam around the entire shaft circumference, or b) paddle-wheel style rollers.

The conventional foam-covered rollers work by rotating next to a supply of toner (14) and picking up and moving the toner in the open cells of the foam. Thus, the open-celled foam acts like a web or a plurality of cup-like cells for scooping and moving toner.

The conventional foam-covered rollers are very prone to contaminating the developer system. Loose particles and pieces of foam, which are left over from the roller manufacturing process or are broken off during roller use, contaminate the toner and cause problems in the developer system. Particularly, the foam pieces tend to score the developer sleeve (16), resulting in development flaws such as white lines.

The conventional paddle-wheel style rollers have spaced horizontal blades or ribs that rotate against the toner or against the blades or sealing surfaces that lie near and parallel to the roller. A paddle-wheel style roller is shown in FIGS. 2A and 2B. Engagement of the paddles with the toner (14), blades (18), or surfaces (27) results in non-uniform angular velocity of the roller. This non-uniform angular velocity results in vibration, relative motion between the photoconductor drum (12) and the EP laser or other light source, and large and varying loads on the roller drive unit. Such vibration and shock waves degrade the image precision and increase the wear rate of the EP system.

SUMMARY OF THE INVENTION

Objects of the present invention include the elimination of the contamination problems and the undo loading problems of conventional EP material-moving rollers. The present invention eliminates these problems, and thus prevents the associated printing flaws and excessive wear and tear on the EP equipment.

The present invention comprises a novel outer surface on material-moving rollers or cylinders, and, particularly, on the upper and lower rollers of a developer canister. The roller outer surface is non-disintegrating, ridged, and angled, for preventing the problems associated with prior rollers.

The outer surface is sturdy and non-disintegrating so that no contamination enters the toner or other EP material and so that no particles or pieces of the roller enter the toner or other EP material. Thus, the present invention minimizes or eliminates marring of EP surfaces by contamination of the toner and carrier material with pieces of roller.

The roller outer surface is uneven, in that it has a combination of ridges and troughs that move toner or other EP material. The arrangement of these ridges has at least two important effects:

1) The ridges distribute the time of engagement of the roller with the EP material or surfaces. The roller outer surface include at least one portion of a ridge at all radial positions around the circumference of the roller, so that the roller continuously presents a ridge surface to the toner or to a restrictive surface against which the roller is moving the toner. There are preferably no troughs which extend horizontally (axially) all the way from end-to-end along the roller. In other words, an end view of the invented roller shows ridges extending out from the roller at all radial positions all the way around the roller circumference. Therefore, instead of striking material or surfaces intermittently with spaced, horizontal paddles, the invented roller surface has ridges which continuously contact the EP material or surfaces.

The continuous, rather than intermittent, presentation of a ridge surface to the EP material or surface distributes the time of engagement of the ridges across the entire period of the roller revolution, and therefore distributes and smooths-out the load placed on the roller drive. This distributed time of engagement greatly minimizes the load fluctuation and vibration of the roller drive unit and minimizes the resultant problems in the EP device.

2) The rotation of the invented roller in or next to the EP material results in material movement in a direction perpendicular to the roller axis which is substantially greater than that of the axial movement. The roller causes either top delivery of the material over the roller, as is typical for the upper roller of a developer, or preferential motion of the material against a restrictive surface, as is typical for the lower roller of the developer.

In order to effectively move EP material over the top of the roller or against or along a restrictive surface, the ridges should substantially extend at an angle across the roller outer surface, rather than horizontally (that is, rather than parallel to the roller axis) and rather than radially (that is, rather than perpendicularly to the roller axis). In the language of screw threads, the ridge or ridges should extend across the roller surface at a screw lead angle ($\lambda$) greater than 0° and less than 90° as illustrated in FIG. 3. It is preferred to have a substantial portion of the ridge(s) at a lead angle ($\lambda$) ranging from about 45–75°. Lead angles in this preferred range result in efficient material movement in a direction perpendicular to the roller axis rather than axial direction.

A preferred embodiment of the improved material-moving roller comprises an outer surface having external ridges arranged in either a right or left-hand screw-thread pattern, or a pattern switching from right-hand to left-hand thread orientation, or a random wave-like pattern. This preferred embodiment may be made by surrounding a drive shaft with a flexible tube having a plurality of external ridges, twisting the tube to arrange the ridges in an angled pattern, and then securing the tube to the shaft to keep the ridges in the angled pattern.

Another preferred embodiment of the invented roller is made by wrapping and securing a monofilament line or other non-disintegrating cord around the roller in a generally spiral or angled pattern.

DETAILED DESCRIPTION OF THE INVENTION

Figure 1:
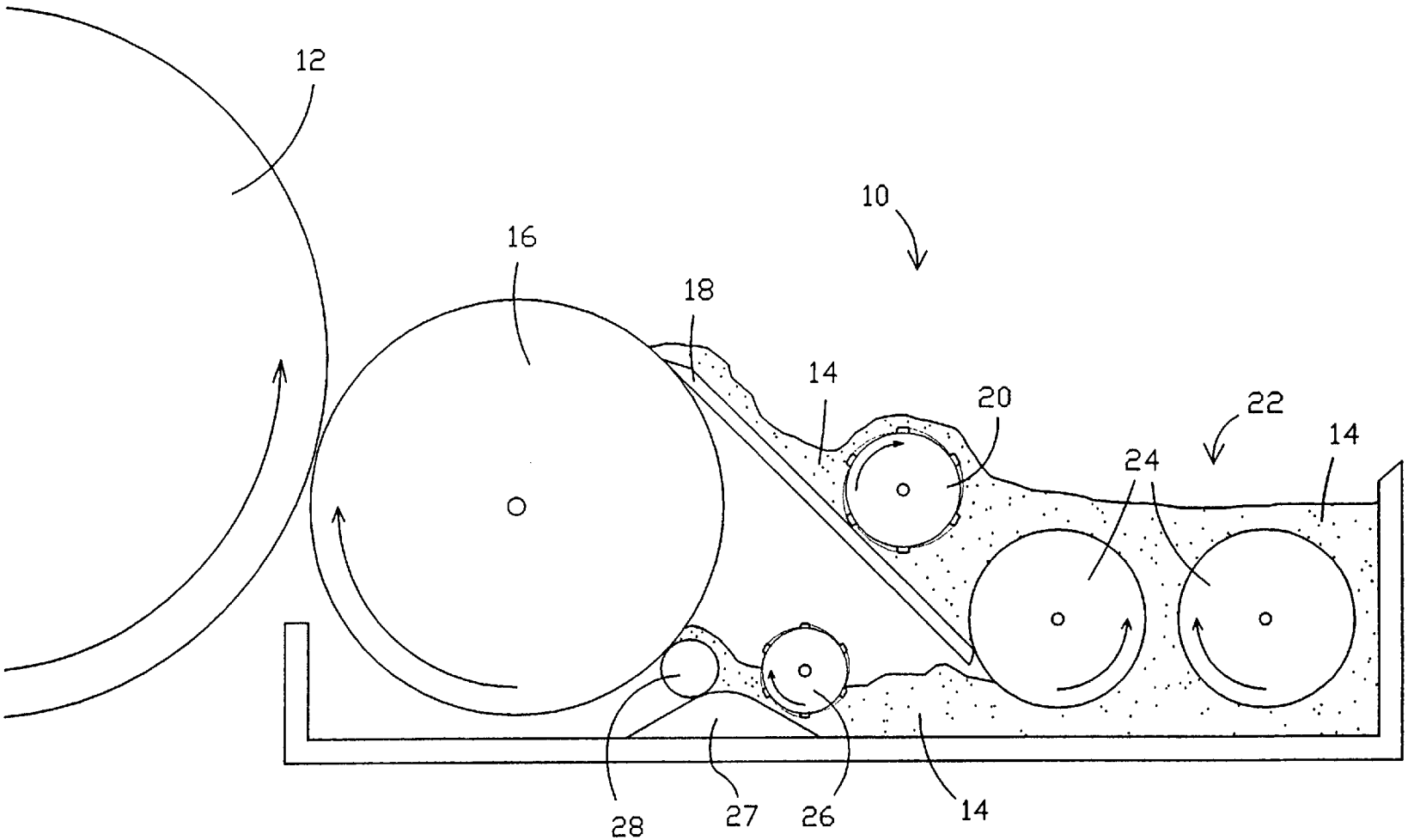
FIG. 1 is a schematic end view of an EP toner developer canister.
Figure 2A:
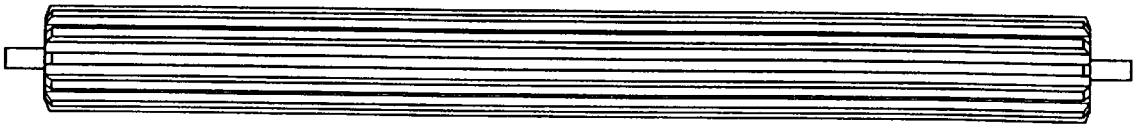
FIG. 2A (PRIOR ART)
FIG. 2A is a front view of a conventional paddle-wheel style roller.
Figure 2B:
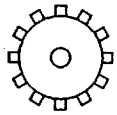
FIG. 2B (PRIOR ART)
FIG. 2B is an end view of the conventional roller of FIG. 2A.
Figure 3:
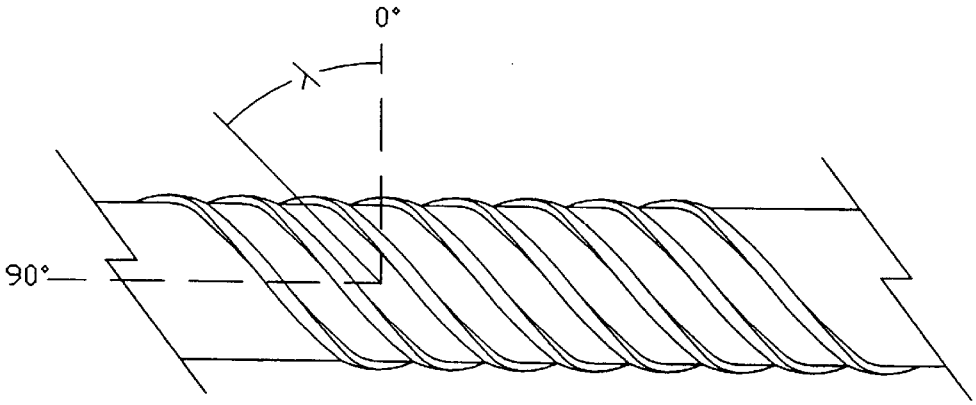
FIG. 3 is a schematic representation of a screw lead angle of a thread on a screw or shaft.
Figure 4A:
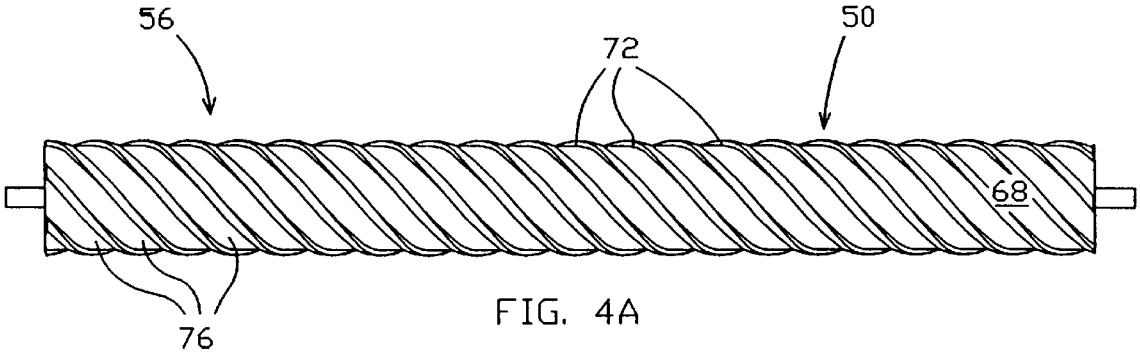
FIG. 4A is a front view of one embodiment of the invention, a roller having an outer tube with ridges arranged in right-hand-thread position.
Figure 4B:
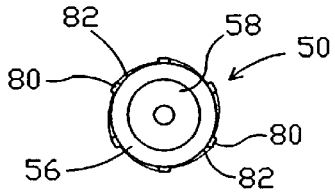
FIG. 4B is an end view of the embodiment of FIG. 4A.
Figure 5:
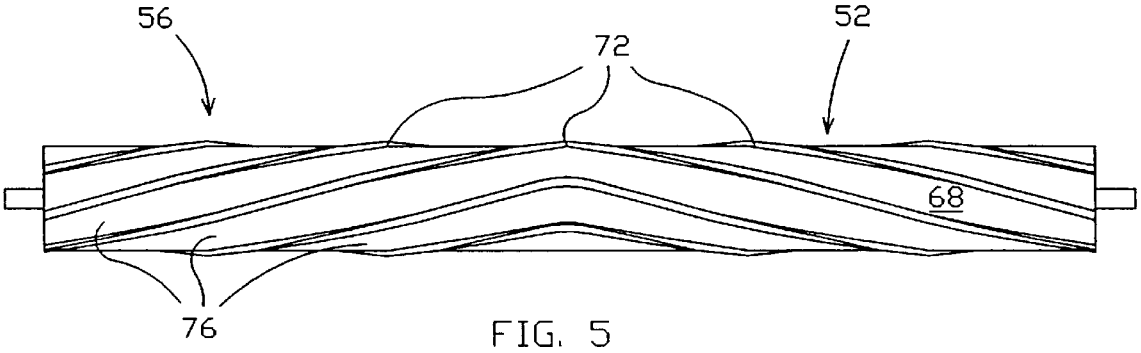
FIG. 5 is a front view of another embodiment of the invention, a roller having an outer tube with ridges arranged in a combination of right and left-handed-thread positions.
Figure 6:
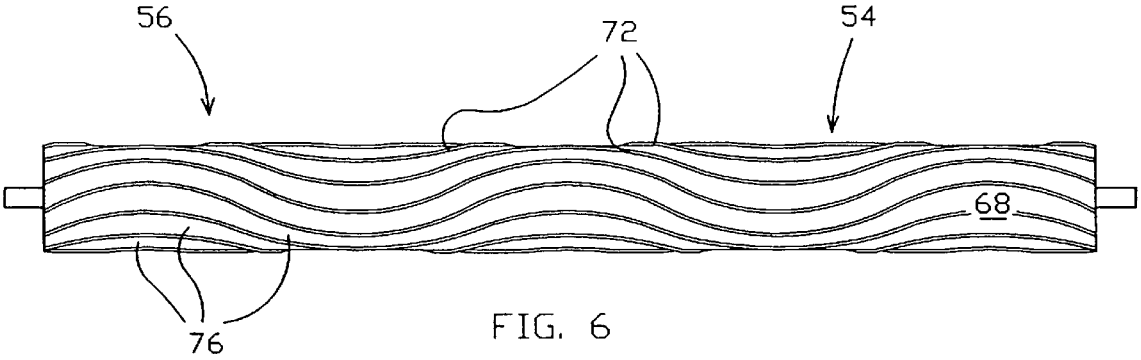
FIG. 6 is a front view of another embodiment of the invention, a roller having an outer tube with ridges arranged in a wave-like pattern.
Figure 7:
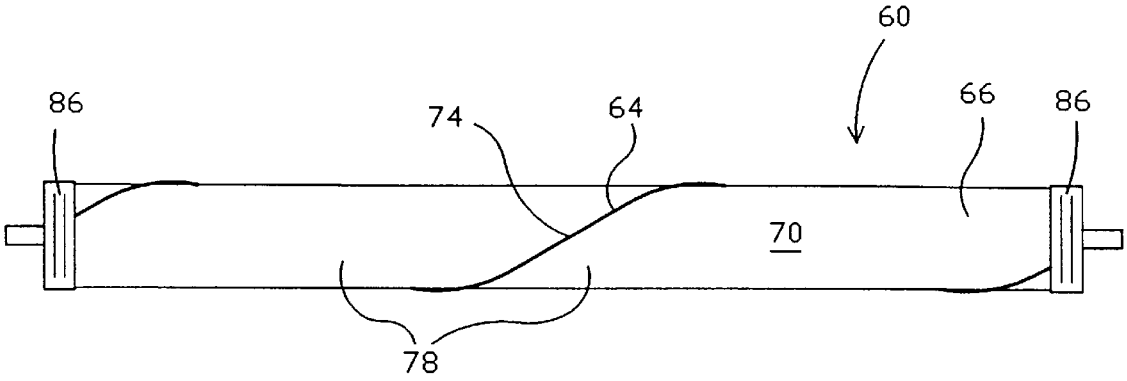
FIG. 7 is a front view of another embodiment of the invention, a roller having a monofilament line wrapped around the roller to create ridges in a left-hand-thread orientation.
Figure 8:
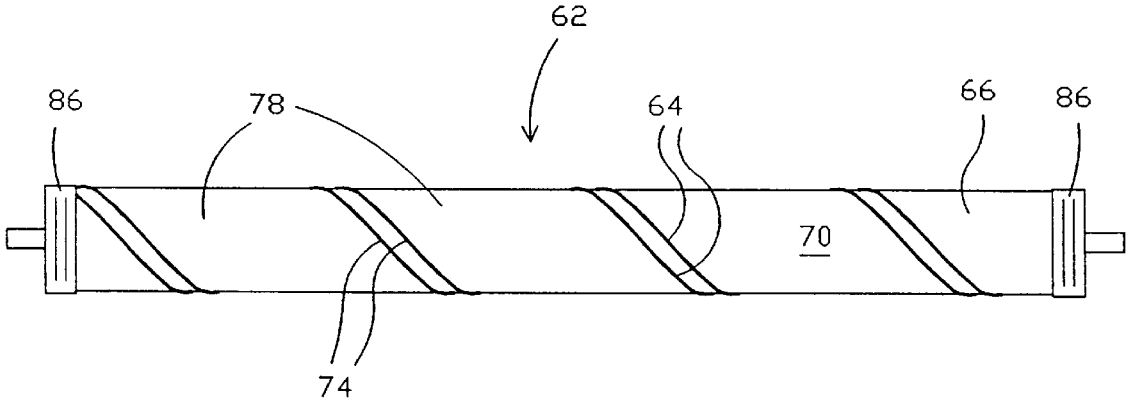
FIG. 8 is a front view of another embodiment of the invention, a roller having a double monofilament line wrapped around the roller to create ridges in a right-hand-thread orientation.
Figure 9:
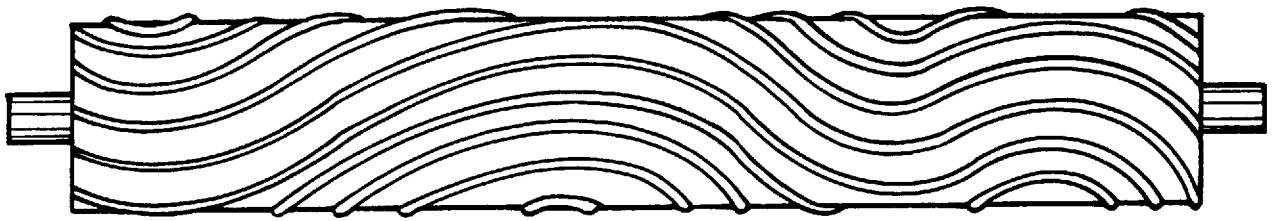
FIG. 9 is a front view of another embodiment of the invention, a roller with a tube twisted into an irregular wave-like pattern.

Referring to FIGS. 4–8, there are shown several, but not the only, embodiments of the invented material-moving roller. FIGS. 4–6 show embodiments of rollers (50,52,54) according to the invention, which are made by twisting and securing a soft, twistable ridged tube (56) on a shaft (58). FIGS. 7 and 8 show embodiments of the invented roller (60,62), which are made by wrapping and securing a monofilament line (64) around a cylinder (66).

Each roller embodiment has an outer surface (68, 70) with a texture that is ridged, angled and non-disintegrating. The outer surface ridges (72, 74) and troughs (76, 78) produce an uneven surface for moving EP material. The ridges (72, 74) are angled in that they extend across the outer surface (68, 70) in a non-axial and non-radial direction, that is, with a "lead angle" of $0<\lambda<90$. The angled nature of the ridges is both for distributing the time of engagement of the ridges and for preferentially moving material in a radial direction. The outer surface and ridges are non-disintegrating, so that no contamination enters the toner to eventually mar the EP surfaces and cause print flaws.

The non-horizontal nature of the ridges (72, 74) result in there continuously being at least one, and preferably numerous, portions of a ridge (72, 74) being presented to the EP material or surface at all times during the revolution of the roller (50, 52, 54, 60, 62). The non-horizontal ridge portions result in continuous and smooth, rather than intermittent, contact with the material to be moved or the restrictive surface against which the material is pushed. Preferably, but not necessarily, a substantial portion of the ridges lie at a lead angle of less than about 75° on the outer surface, so that continuous and smooth ridge contact can be achieved without a large number of closely-spaced ridges.

In addition, the lead angle ($\lambda$) of the ridges (72, 74) is preferably greater than about 45°, so that rotation of the roller produces EP material movement substantially perpendicular to the roller axis rather than axial movement of EP material. Thus, the invented roller moves material over the roller for top delivery or generally perpendicularly to the roller axis along a restrictive surface.

Therefore, the preferred angle of the ridges is "$45°<\lambda<75°$, for optimizing both ridge contact and the perpendicular movement. Not all areas of the ridges need be in this preferred range, but preferably a substantial portion are in this range. For example, the ridge areas that transition between right-handed and left-handed ridge orientation will typically be approximately horizontal.

In the description and claims, the term "lead angle" is used to clarify the angles at which the ridges preferably lie on the roller surface, but is not intended to limit the invention to embodiments with ridges that spiral or encircle the roller circumference like screw threads.

The outer surface (68) of the rollers (50, 52, 54) in FIGS. 4–6 is produced when a tube (56) of soft, twistable material is installed over the shaft (58) and then twisted and secured in place. The tube (56) may be secured in place preferably by being tight enough on the shaft (58) that it stays in the twisted position without any other attachment means. Alternatively, the tube (56) may be glued in place on the shaft (58) or secured to the shaft by other attachment means. The tube (56) may be made of RTV silicon, and cyanoacrylate adhesive may be used to secure the tube. By using the word "soft", it is meant that the tube (56) preferably exhibits a durometer reading in the range of 35–60 Shore A. By using the word "twistable", it is meant that the tube (56) can be twisted radially around the shaft (58) enough to produce non-horizontal ridge portions and without creating significant buckling, significant stretching, or weakening of the tube (56).

FIG. 4B is an end view of the roller in FIG. 4A, illustrating that the angled ridges (72) are arranged so that no trough (76) area is visible in an end view, but only ridge ends (80) and ridge sides (82) are visible. In other words, no trough (76) extends horizontally (or axially) all the way from end-to-end on the roller.

In the embodiments of FIG. 4 and 5, the tube (56) is twisted to place the ridges (72) in a generally right-handed thread orientation, and a right-hand and left-hand thread combination, respectively. FIG. 6 shows a more wave-style twisting, resulting in substantial angled portions of ridges with some horizontal ridge regions at the transition areas between right and left-handed angled ridges. The FIG. 6 ridges "wave" along the roller surface rather than spiral around the roller, extending less than one-half revolution around the roller.

The twisting of the tube (56) may create a regular, consistent pattern, as in FIGS. 4–6. Alternatively, the twisting may be done to create a more irregular pattern, for example, with varying lead angles along the length of the roller.

In the embodiments of FIG. 7 and 8, the outer surface (70) texture is made by wrapping and securing monofilament line (64) of about 0.6–1.0 mm diameter around a cylinder (66), so that the line (64) forms ridges (74) on the outer surface (70) and the spaces between the portions of line (64) form the troughs (78). The line (64) may be wrapped in a regular, spiral pattern, as in FIGS. 7 and 8, or a more irregular pattern. The line may be secured, for example, by adhesive, by anchoring caps (86) on the ends, tying or gluing in holes drilled in the ends, or a combination of these methods. Although the line (64) is preferably a monofilament, the term "line" in the description and claims may include monofilaments or multifilaments, and includes thread, string, cord, or rope that is nondisintegrating.

Alternatively, the roller outer surface may be made, according to the invention, by molding, extruding, machining, or cutting, or by other methods of forming ridges and troughs on the outer surface. Rollers made by such methods may have ridges that are inherently angled without the outer surface being twisted. In the description and claims, the terms "ridges" and "plurality of ridges" mean that either a single ridge extends around and/or along the roller to create raised and depressed areas preferably all over the roller outer surface, or, that several separate ridges extend around and/or along the roller to do so. So, "ridges" includes one or more long, continuous ridges, or a plurality of shorter, separate ridges.

Although this invention has been described above with reference to particular means, materials and embodiments, it is to be understood that the invention is not limited to these disclosed particulars, but extends instead to all equivalents within the scope of the following claims.

What is claimed is:

1. An electrophotographic developer canister for handling toner, the developer canister comprising:

a reservoir at a first end of the canister, the reservoir receiving toner and having a bottom region and a top region;

a mixing roller rotatably mounted in said reservoir for mixing the toner;

a developer sleeve rotatably mounted at a second end of the canister, the developer sleeve having an upper area and a lower area;

a lower roller rotatably mounted in the canister between the mixing roller and the developer sleeve near the bottom region of the reservoir and adapted to move toner from the bottom region of the reservoir toward the developer sleeve;

a residual toner removal means contacting the upper area of the developer sleeve for removing residual toner from the developer sleeve as the developer sleeve rotates against the removal means; and an upper roller having an axial length rotatably mounted in the canister generally parallel to the developer sleeve, between the residual toner removal means and the mixing roller, and in contact with residual toner removed from the developer sleeve, wherein the upper roller has an outer surface having ridges positioned substantially at lead angles in the range of 45–75 degrees and extending along the axial length of the roller for moving the residual toner away from the removal means, radially over the upper roller, and into the reservoir top region generally above the mixing roller, and wherein the upper roller outer surface is a soft surface exhibiting a durometer reading in the range of 35–60 Shore A.

2. A developer canister as set forth in claim 1, wherein the lower roller has an axial length and a lower roller outer surface having ridges positioned substantially at lead angles in the range of 45–75 degrees for moving toner from the reservoir, radially around the lower roller, and toward the developer sleeve.

3. A developer canister as set forth in claim 2, wherein the lower roller outer surface is a soft surface exhibiting a durometer reading in the range of 35–60 Shore A.

4. An electrophotographic developer canister for handling toner, the developer canister comprising:

a reservoir at a first end of the canister and receiving toner;

a mixing roller rotatably mounted in said reservoir for mixing the toner;

a developer sleeve rotatably mounted at a second end of the canister, the developer sleeve having an upper area and a lower area;

a lower roller rotatably mounted in the canister between the mixing roller and the developer sleeve and adapted to move toner from the bottom region of the reservoir toward the developer sleeve;

a residual toner removal means contacting the upper area of the developer sleeve for removing residual toner from the developer sleeve as the developer sleeve rotates against the removal means; and an upper roller having an axial length rotatably mounted in the canister generally parallel to the developer sleeve, between the residual toner removal means and the mixing roller, and in contact with residual toner removed from the developer sleeve, wherein the upper roller has an outer surface having ridges positioned substantially at lead angles in the range of 45–75 degrees and extending along the axial length of the roller for moving the residual toner away from the removal means, radially over the upper roller, and into the reservoir top region generally above the mixing roller, and wherein the upper roller comprises a cylinder with an outer surface, and a line wrapped around the outer surface to form said ridges.

5. A developer canister as set forth in claim 4, wherein said line is a monofilament line.

6. A developer canister as set forth in claim 4, wherein the lower roller has an axial length and a lower roller outer surface having ridges positioned substantially at lead angles in the range of 45–75 degrees for moving toner from the reservoir, radially around the lower roller, and toward the developer sleeve.

7. An electrophotographic developer canister for handling toner, the developer canister comprising:

a reservoir at a first end of the canister and receiving toner;

a mixing roller rotatably mounted in said reservoir for mixing the toner;

a developer sleeve rotatably mounted at a second end of the canister, the developer sleeve having an upper area and a lower area;

a lower roller rotatably mounted in the canister between the mixing roller and the developer sleeve and adapted to move toner from the bottom region of the reservoir toward the developer sleeve;

a residual toner removal means contacting the upper area of the developer sleeve for removing residual toner from the developer sleeve as the developer sleeve rotates against the removal means; and an upper roller having an axial length rotatably mounted in the canister generally parallel to the developer sleeve, between the residual toner removal means and the mixing roller, and in contact with residual toner removed from the developer sleeve, wherein the upper roller has an outer surface having ridges positioned substantially at lead angles in the range of 45–75 degrees and extending along the axial length of the roller for moving the residual toner away from the removal means, radially over the upper roller, and into the reservoir top region generally above the mixing roller;

wherein the upper roller is manufactured by the method comprising:

providing a tube of twistable material having an outer surface with external ridges extending axially along the outer surface;

inserting a shaft into said tube;

radially twisting the tube on the shaft so that the ridges extend at lead angles substantially in the range of 45–75 degrees; and securing the twisted tube to the shaft.

8. A developer canister as set forth in claim 7, wherein the lower roller has an axial length and a lower roller outer surface having ridges positioned substantially at lead angles in the range of 45–75 degrees for moving toner from the reservoir, radially around the lower roller, and toward the developer sleeve.

9. An electrophotographic developer canister for handling toner, the developer canister comprising:

a reservoir at a first end of a canister, the reservoir receiving toner and having a bottom region and a top region;

a mixing roller rotably mounted in said reservoir for mixing the toner;

a developer sleeve rotatably mounted at a second end of the canister, the developer sleeve having an upper area and a lower area;

a lower roller having an axial length and rotatably mounted in the canister between the mixing roller and the developer sleeve and near the bottom region of the reservoir;

wherein the lower roller has an outer surface having ridges positioned substantially at lead angles in the range of 45–75 degrees and extending along the axial length of the roller for moving toner from the bottom region of the reservoir, radially around the lower roller, and toward the developer sleeve, and wherein the lower roller outer surface is a soft surface exhibiting a durometer reading in the range of 35–60 Shore A;

a residual toner removal means contacting the developer sleeve for removing residual toner from the developer sleeve after development; and an upper roller rotatably mounted in the canister between the residual toner removal means and the mixing roller, for moving toner radially away from the removal means and into the reservoir top region generally above the mixing roller.

10. A developer canister as set forth in claim 9, wherein the upper roller has an axial length and is mounted in the canister generally parallel to the developer sleeve, and wherein the upper roller has an upper roller outer surface having ridges positioned substantially at lead angles in the range of 45–75 degrees, for moving the residual toner radially over the upper roller and into the reservoir.

11. A developer canister as set forth in claim 9, further comprising a metering rod between the developer sleeve and the lower roller.

12. An electrophotographic developer canister for handling toner, the developer canister comprising:

a reservoir at a first end of the canister, the reservoir receiving toner and having a bottom region and a top region;

a mixing roller rotatably mounted in said reservoir for mixing the toner;

a developer sleeve rotatable mounted at a second end of the canister, the developer sleeve having an upper area and a lower area;

a lower roller having an axial length and rotatably mounted in the canister between the mixing roller and the developer sleeve and near the bottom region of the reservoir;

wherein the lower roller has an outer surface having ridges positioned substantially at lead angles in the range of 45–75 degrees and extending along the axial length of the roller for moving toner from the bottom region of the reservoir, radially around the lower roller, and toward the developer, and wherein the lower roller comprises a cylinder with an outer surface, and line wrapped around the outer surface to form said ridges;

a residual toner removal means contacting the developer sleeve for removing residual toner from the developer sleeve after development; and an upper roller rotatable mounted in the canister between the residual toner removal means and the mixing roller, for moving toner radially away from the removal means and into the reservoir top region generally above the mixing roller.

13. A developer canister as set forth in claim 12, wherein said line is a monofilament line.

14. A developer canister as set forth in claim 12, wherein the upper roller has an axial length and is mounted in the canister generally parallel to the developer sleeve, and wherein the upper roller has an upper roller outer surface having ridges positioned substantially at lead angles in the range of 45–75 degrees, for moving the residual toner radially over the upper roller and into the reservoir.

15. A developer canister as set forth in claim 12, further comprising a metering rod between the developer sleeve and the lower roller.

16. An electrophotographic developer canister for handling toner the developer canister comprising:

a reservoir at a first end of the canister, the reservoir receiving toner and having a bottom region and a top region;

a mixing roller rotatable mounted in said reservoir for mixing the toner;

a developer sleeve rotatably mounted at a second end of the canister, the developer sleeve having an upper area and a lower area;

a lower roller having an axial length and rotatably mounted in the canister between the mixing roller and the developer sleeve and near the bottom region of the reservoir;

wherein the lower roller has an outer surface having ridges positioned substantially at lead angles in the range of 45–75 degrees and extending along the axial length of the roller for moving toner from the bottom region of the reservoir, radially around the lower roller, and toward the developer;

a residual toner removal means contacting the developer sleeve for removing residual toner from the developer sleeve after development; and an upper roller rotatable mounted in the canister between the residual toner removal means and the mixing roller, for moving toner radially away from the removal means and into the reservoir top region generally above the mixing roller;

wherein the lower roller is manufactured by the method comprising:

providing a tube of twistable material having an outer surface with external ridges extending axially along the outer surface;

inserting a shaft into said tube;

radially twisting the tube on the shaft so that the ridges extend at lead angles substantially in the range of 45–75 degrees; and securing the twisted tube to the shaft.

17. A developer canister as set forth in claim 16, wherein the upper roller has an axial length and is mounted in the canister generally parallel to the developer sleeve, and wherein the upper roller has an upper roller outer surface having ridges positioned substantially at lead angles in the range of 45–75 degrees, for moving the residual toner radially over the upper roller and into the reservoir.

18. A developer canister as set forth in claim 16, further comprising a metering rod between the developer sleeve and the lower roller.

* * * * *